United States Patent [19]

Schick et al.

[11] 4,182,922

[45] Jan. 8, 1980

[54] SYNTHETIC HYDROCARBON LUBRICATING OIL

[75] Inventors: John W. Schick, Cherry Hill; Robert M. Gemmill, Jr., Pitman, both of N.J.

[73] Assignee: Mobil Oil Corporation, New York, N.Y.

[21] Appl. No.: 861,598

[22] Filed: Dec. 19, 1977

[51] Int. Cl.[2] ..... C07C 3/20

[52] U.S. Cl. ..... 585/18; 585/329; 585/517; 585/532

[58] Field of Search ..... 252/59; 260/683.15 B

[56] References Cited

U.S. PATENT DOCUMENTS

| | | | |
|---|---|---|---|
| 3,389,087 | 6/1968 | Kresge et al. | 252/59 |
| 3,676,521 | 7/1972 | Stearns et al. | 252/59 |
| 3,681,302 | 8/1972 | Sweeney | 252/59 |
| 3,697,429 | 10/1972 | Engel et al. | 252/59 |
| 3,923,919 | 12/1975 | Stearns et al. | 252/59 |
| 4,069,162 | 1/1978 | Gardiner et al. | 252/59 |

*Primary Examiner*—C. Davis

*Attorney, Agent, or Firm*—Charles A. Huggett; Raymond W. Barclay; Claude E. Setliff

[57] ABSTRACT

Synthetic hydrocarbon oils having excellent viscosity index and pour point combinations. They are made by a process involving the copolymerization of propylene or propylene plus higher 1-olefins with small amounts of ethylene.

15 Claims, No Drawings

SYNTHETIC HYDROCARBON LUBRICATING OIL

BACKGROUND OF THE INVENTION

1. Field of the Invention

The invention relates to synthetic hydrocarbon oils and a method for their manufacture. More particularly, the invention is concerned with copolymers of propylene, higher 1-olefins and ethylene, wherein the ethylene in the final product is present in very small amounts.

2. Discussion of the Prior Art

Copolymerization of olefin mixtures using a Ziegler catalyst is known. These may, for example, include a catalyst made by combining a transition metal compound with a metal alkyl or an alkyl metal halide.

As the prior art knows, as taught, for example, in U.S. Pat. No. 2,923,919, in producing synthetic hydrocarbon lubricating oils, the attainment of high viscosity index is generally due to the presence in the overall oil of high molecular weight polymer ends. This same patent teaches that when the ethylene content falls below 29 mol % of ethylene in the oil, the combination of high pour point and low viscosity index will be unacceptable.

Other U.S. patents having similar disclosures are U.S. Pat. Nos. 3,676,521, 3,737,477 and 3,851,011.

None of these patents suggest that synthetic hydrocarbon oils having acceptable pour points and viscosity indexes can be made by copolymerizing propylene and ethylene when the finished oil has a very low content of ethylene.

SUMMARY OF THE INVENTION

In accordance with the invention there is provided an oil which is a copolymer of ethylene and propylene or ethylene and propylene plus a 1-olefin having 4 to 10 carbon atoms, the oil having a maximum pour point of −35° F., but can range from −35° to <−65° F., and a viscosity index of from about 100 to 135, preferably about 125 minimum, and containing from about 2% to about 10% by weight of ethylene in the final product, preferably about 4% to about 6%.

Aslo provided is a method of making the oil which comprises the steps of (1) reacting propylene and ethylene together in the presence of $VOCl_3$ and an alkyl aluminum sesquichloride and (2) reacting propylene or propylene plus a higher 1-olefin with the product of step (1) in the presence of a Friedel-Crafts catalyst. Other catalysts that may be used in step (1) are $VCl_3$, $VCl_4$, vanadium esters (esters of $VOCl_3$ and alcohols) and other aluminum catalysts such as diethyl aluminum chloride ($Et_2AlCl$).

DESCRIPTION OF SPECIFIC EMBODIMENTS

As has already been disclosed, the process of making the oil of this invention involves two consecutive steps, which are preferably carried out in the same reactor. The first step involves the formation of an ethylene-propylene copolymer oil in the presence of a Ziegler-Natta catalyst. Under these conditions, ethylene is highly reactive and forms comparatively straight-chain chain copolymers with propylene which have a high VI value. Hydrogen pressure in this step serves a dual function of molecular weight control and hydrogenation. The Ziegler-Natta catalyst is quenched with an alcohol, which also serves as the promoter for the second step catalyst system.

In the second step, the bulk of the propylene or propylene plus the 1-olefin feed is reacted in the presence of a Friedel-Crafts catalyst. Propylene or the mixed olefin is highly reactive in the system, whereas ethylene is virtually non-reactive.

One prime feature of the invention is the low amount of ethylene present in the polymer. Even with the ethylene in the final product within the range of from about 4 wt % to about 8 wt %, oils having viscosities suitable for use in internal combustion engines are readily obtained. They are unique and possess several properties that would be unexpected from the prior art. For one, the oils have a maximum pour point of −35° F. For another, the oils have viscosity indices, determined in accordance with ASTM Method D2270-74, of about 100 to 135. These properties, particularly the combination thereof, are entirely unexpected from the known prior art.

The invention also provides a wide variety of molecular weight products having the desired properties. Thus, final copolymers in the molecular weight (number average here and throughout) range of from about 300 to about 2000 can be made employing the two step processes. We prefer to make a copolymer in the first step having an average molecular weight of from about 400 to about 1000 and then to provide sufficient propylene reaction in the second step to obtain the final desired molecular weight.

In more particular aspect, the process to make the product may be further illustrated as follows. In the first step, a hydrocarbon feed comprising from about 60% by weight to about 80% by weight of propylene and from about 40% by weight to about 20% by weight of ethylene is charged to a reactor containing the Ziegler-Natta catalyst and an inert paraffinic hydrocarbon solvent. This feed is reacted at a temperature of from about 60° F. to about 100° F. under a hydrogen pressure of from about 400 psig to about 1200 psig, preferably from about 800 to about 1200 psig. The catalyst is quenched by adding a monohydric alcohol having from 1 to 10 carbon atoms, e.g., n-propanol. In this step, the reaction is carried out until a molecular weight within the range mentioned above is obtained, i.e., usually for from about ½ hour to about 5 hours.

In the second step, the Friedel-Crafts catalyst and additional propylene or propylene plus higher olefins are added and the reaction mass is reacted at from about 60° F. to about 120° F. until the final desired molecular weight is obtained. The time is of the order of from about 1 hour to about 2 hours. It is important to use sufficient propylene or propylene plus a higher 1-olefin in this step to give a concentration thereof in the total feed for both steps of from about 90.0% to about 99.0% by weight, giving a concentration of ethylene in the total feed of from about 1.0% to about 10% by weight.

It is to be understood that the finished oils obtained directly can be used, after topping, without fractionation, if desired, or even without topping. Topping is generally practiced to remove light ends which find uses as non-viscous lubricants, and in other applications requiring low molecular weight material. It is also to be understood that the products find use for many purposes, such as in moderate service, and may be stabilized by the addition of one or more inhibitors, e.g., an oxidation inhibitor.

Having defined the product and process in general terms, the following will illustrate the invention more specifically.

EXAMPLE 1

One liter of n-hexane was charged into an autoclave. To this was added 0.0041 mole of $VOCl_3$ and 0.0062 mole of $Et_3Al_2Cl_3$. 3.6 moles of propylene were added rapidly from a pressure burette and the pressure was immediately increased to 1200 psig with hydrogen. Ethylene was fed into the autoclave for 45 minutes at 75° F. At the end of this time, 1.8 moles had been added. The reaction mass was held at ambient temperature for 45 minutes. This was followed by addition of 15 ml of 1-propanol and a ten-minute stirring period.

In the second stage, 0.5 mole of $BF_3$ was added to the reaction mixture, and 19.7 moles of propylene were fed in over a 1.0-hour period at 85°–95° F. at a maximum pressure of about 100 psig. The hold time following propylene additon was 1.0 hour.

The $BF_3$ catalyst was vented and 50 ml of $NH_4OH$ was added and the mixture was stirred 15 minutes to neutralize the remaining catalyst. The product was removed from the autoclave, washed with dilute HCl, dilute $NaHCO_3$ and water, in that order, and then was filtered to remove the small amount of solid polymer formed.

The solvent was then stripped at atmospheric pressure to a temperature of 365° F. and was then vacuum topped to 1 mm of Hg at 298° F. The oil was filtered and hydrogenated over a nickel-on-kieselguhr catalyst. Hydrogenation was carried out for 4 hours at 350° F. at a hydrogen pressure of 1000 psig. The final product was clear, water-white.

EXAMPLES 2–4

In the Examples shown in Table 1, the procedure was essentially as outlined in Example 1. The exception was that, instead of using all propylene in the second stage, mixtures of propylene and higher 1-olefins were employed.

TABLE I

| | Example 1 | Example 2 |
|---|---|---|
| Solvent n-hexane l | | 1.0 |
| Step 1 | | |
| $C_2H_4$ moles | | 1.80 |
| $C_3H_6$ moles | | 3.60 |
| Catalyst - type | | $VOCl_3$ |
| -moles | | 0.0041 |
| Co-catalyst type | | $Et_3Al_2Cl_3$ |
| moles | | 0.0062 |
| Hydrogen psig | | 1200 |
| Reaction Temp. °F. | | 75 |
| Feed time hrs. | | 0.75 |
| Hold time hrs. | | 0.75 |
| Promoter type | | 1-propanol |
| ml. | | 15 |
| Step 2 | | |
| $C_3H_6$ moles | | 9.00 |
| $C_4H_8$ moles | | 8.03 |
| $C_6H_{12}$ moles | | — |
| $C_{10}H_{20}$ moles | | — |
| Catalyst type | | $BF_3$ |
| moles | | 0.50 |
| Reaction Temp. °F. | | 94 |
| Feed time hrs. | | 1.0 |
| Hold time hrs. | | 1.0 |
| Total Oil | | |
| $C_2H_4$ wt % of feed | 4.90 | 4.90 |
| Olefin Conversion, % | 94.8+ | 96.4+ |
| Finished Oil | | |

TABLE I-continued

| | Example 1 | Example 2 |
|---|---|---|
| Yield % of total feed | 74.5 | 75.0 |
| $C_2H_4$ wt % (approx.) | 5.5 | 5.5 |
| Viscosity index | 103 | 113 |
| KV at 100° C. cs | 9.45 | 8.69 |
| KV at 40° C. cs | 74.96 | 62.21 |
| KV at 0° F. cs | — | 7729 |
| CCS at 0° F. P | 96.20 | 47.80 |
| Pour Pt. °F. | −40 | <−65 |
| Flash Pt. °F. | 370 | 385 |
| Solvent n-hexane l | 1.0 | 1.0 |
| Step 1 | | |
| $C_2H_4$ moles | 1.80 | 1.80 |
| $C_3H_6$ moles | 3.60 | 3.60 |
| Catalyst - type | $VOCl_3$ | $VOCl_3$ |
| - moles | 0.0041 | 0.0041 |
| Co-catalyst type | $Et_3Al_2Cl_3$ | $Et_3Al_2Cl_3$ |
| moles | 0.0062 | 0.0062 |
| Hydrogen psig | 1200 | 1200 |
| Reaction Temp. °F. | 75 | 75 |
| Feed time hrs. | 0.75 | 0.75 |
| Hold time hrs. | 0.75 | 0.75 |
| Promoter type | 1-propanol | 1-propanol |
| ml. | 15 | 15 |
| Step 2 | | |
| $C_3H_6$ moles | 9.00 | 9.00 |
| $C_4H_8$ moles | — | — |
| $C_6H_{12}$ moles | 5.35 | — |
| $C_{10}H_{20}$ moles | | 3.21 |
| Catalyst type | $BF_3$ | $BF_3$ |
| moles | 0.51 | 0.52 |
| Reaction Temp. °F. | 88 | 88 |
| Feed time hrs. | 1.0 | 0.90 |
| Hold time hrs. | 1.0 | 1.0 |
| Total Oil | | |
| $C_2H_4$ wt % of feed | 4.90 | 4.90 |
| Olefin Conversion, % | 95.1+ | 95.8+ |
| Finished Oil | | |
| Yield % of total feed | 76.4 | 87.0 |
| $C_2H_4$ wt % (approx.) | 5.5 | 6.5 |
| Viscosity index | 128 | 133 |
| KV at 100° C. cs | 8.28 | 7.57 |
| KV at 40° C. cs | 53.13 | 45.51 |
| KV at 0° F. cs | 3773 | 2009 |
| CCS at 0° F. P | 26.50 | 16.50 |
| Pour Pt. °F. | <−65 | <−65 |
| Flash Pt. °F. | 390 | 395 |

We claim:

1. A lubricating oil comprising a copolymer of ethylene and propylene or a copolymer of ethylene, propylene and a higher 1-olefin having from 4 to 10 carbon atoms, wherein the oil has a pour point of from about −35° F. to <−65° F. and a viscosity index of from about 100 to about 135 and wherein that portion of the copolymer formed from ethylene is from about 2% to about 10% by weight, said oil being made by a method comprising (1) reacting ethylene and propylene in the presence of (a) a vanadium-containing catalyst and (b) an aluminum-containing catalyst and (2) reacting the step (1) product with propylene or mixed propylene-higher 1-olefin in the presence of a Friedel-Crafts catalyst.

2. The copolymer of claim 1 wherein the pour point is a maximum of −35° F. and the viscosity index is a maximum of 135.

3. The oil of claim 1 wherein that portion of the copolymer formed from ethylene is from about 4% to about 6% by weight.

4. The copolymer of claim 1 wherein the higher 1-olefin is butene.

5. The copolymer of claim 1 wherein the higher 1-olefin is hexene.

6. The copolymer of claim 1 wherein the higher 1-olefin is decene.

7. A method for preparing a lubricating oil from ethylene and propylene or from ethylene and a mixture of propylene and a higher 1-olefin containing 4 to 10 carbon atoms comprising the steps of (1) reacting ethylene and propylene in the presence of (a) a vanadium-containing catalyst and (b) an aluminum-containing catalyst and (2) reacting the step (1) product with propylene or mixed propylene-higher 1-olefin in the presence of a Friedel-Crafts catalyst, such that that portion of the oil formed from ethylene is from about 2 to about 10% by weight.

8. The method of claim 7 wherein that portion of the oil formed from ethylene is from about 4% to about 6% by weight.

9. The method of claim 7 wherein the higher 1-olefin is butene.

10. The method of claim 7 wherein the higher 1-olefin is hexene.

11. The method of claim 7 wherein the higher 1-olefin is decene.

12. The method of claim 7 wherein in step (1) the feed comprises from 60% to 80% by weight of propylene and from about 40% to about 20% by weight of ethylene.

13. The method of claim 7 wherein the reaction in step (1) is quenched by adding a monohydric alcohol containing 1 to 10 carbon atoms.

14. The method of claim 13 wherein the alcohol is n-propanol.

15. The method of claim 7 wherein in step (2) sufficient propylene or propylene plus higher 1-olefin is used to give a concentration thereof in the total feed of from about 90% to about 99% by weight, the remainder of the total olefin feed being ethylene.

* * * * *

UNITED STATES PATENT AND TRADEMARK OFFICE

CERTIFICATE OF CORRECTION

PATENT NO. : 4,182,922

DATED : January 8, 1980

INVENTOR(S) : JOHN W. SCHICK and ROBERT M. GEMMILL, JR.

It is certified that error appears in the above-identified patent and that said Letters Patent are hereby corrected as shown below:

The portion of column 4 entitled "Table 1-continued" and as shown on the left below, should appear as shown on the right below.

TABLE I-continued

| | Example 1 | Example 2 |
|---|---|---|
| Yield % of total feed | 74.5 | 75.0 |
| $C_2H_4$ wt % (approx.) | 5.5 | 5.5 |
| Viscosity index | 103 | 113 |
| KV at 100° C. cs | 9.45 | 8.69 |
| KV at 40° C. cs | 74.96 | 62.21 |
| KV at 0° F. cs | — | 7729 |
| CCS at 0° F. P | 96.20 | 47.80 |
| Pour Pt. °F. | −40 | <−65 |
| Flash Pt. °F. | 370 | 385 |
| Solvent n-hexane l | 1.0 | 1.0 |
| Step 1 | | |
| $C_2H_4$ moles | 1.80 | 1.80 |
| $C_3H_6$ moles | 3.60 | 3.60 |
| Catalyst - type | $VOCl_3$ | $VOCl_3$ |
| - moles | 0.0041 | 0.0041 |
| Co-catalyst type | $Et_3Al_2Cl_3$ | $Et_3Al_2Cl_3$ |
| moles | 0.0062 | 0.0062 |
| Hydrogen psig | 1200 | 1200 |
| Reaction Temp. °F. | 75 | 75 |
| Feed time hrs. | 0.75 | 0.75 |
| Hold time hrs. | 0.75 | 0.75 |
| Promoter type | 1-propanol | 1-propanol |
| ml. | 15 | 15 |

TABLE I-continued

| | Example 1 | Example 2 |
|---|---|---|
| Yield % of total feed | 74.5 | 75.0 |
| $C_2H_4$ wt % (approx.) | 5.5 | 5.5 |
| Viscosity index | 103 | 113 |
| KV at 100° C. cs | 9.45 | 8.69 |
| KV at 40° C. cs | 74.96 | 62.21 |
| KV at 0° F. cs | — | 7729 |
| CCS at 0° F. P | 96.20 | 47.80 |
| Pour Pt. °F. | −40 | <−65 |
| Flash Pt. °F. | 370 | 385 |
| | **Example 3** | **Example 4** |
| Solvent n-hexane l | 1.0 | 1.0 |
| Step 1 | | |
| $C_2H_4$ moles | 1.80 | 1.80 |
| $C_3H_6$ moles | 3.60 | 3.60 |
| Catalyst - type | $VOCl_3$ | $VOCl_3$ |
| - moles | 0.0041 | 0.0041 |
| Co-catalyst type | $Et_3Al_2Cl_3$ | $Et_3Al_2Cl_3$ |
| moles | 0.0062 | 0.0062 |
| Hydrogen psig | 1200 | 1200 |
| Reaction Temp. °F. | 75 | 75 |
| Feed time hrs. | 0.75 | 0.75 |
| Hold time hrs. | 0.75 | 0.75 |
| Promoter type | 1-propanol | 1-propanol |
| ml. | 15 | 15 |

Signed and Sealed this

*Fifth* Day of *August 1980*

[SEAL]

*Attest:*

SIDNEY A. DIAMOND

*Attesting Officer*

*Commissioner of Patents and Trademarks*